US007582044B2

(12) United States Patent
Múgica Miguel et al.

(10) Patent No.: US 7,582,044 B2
(45) Date of Patent: Sep. 1, 2009

(54) TRAINING BENCH FOR CYCLISTS

(76) Inventors: Jacobo Múgica Miguel, Siervas de Jesús, 37-5°, Vitoria (ES) E-01001; Luis Saracho Rotaeche, Siervas de Jesús, 37-5°, Vitoria (ES) E-01001

( * ) Notice: Subject to any disclaimer, the term of this patent is extended or adjusted under 35 U.S.C. 154(b) by 8 days.

(21) Appl. No.: 10/554,172

(22) PCT Filed: Apr. 23, 2004

(86) PCT No.: PCT/ES2004/000175

§ 371 (c)(1),
(2), (4) Date: Oct. 24, 2006

(87) PCT Pub. No.: WO2004/094006

PCT Pub. Date: Nov. 4, 2004

(65) Prior Publication Data

US 2007/0087909 A1 Apr. 19, 2007

(30) Foreign Application Priority Data

Apr. 23, 2003 (ES) ..... 200300937

(51) Int. Cl.
*A63B 22/06* (2006.01)

(52) U.S. Cl. ..... 482/57; 482/61

(58) Field of Classification Search ..... 482/51, 482/54, 57, 61, 72; 601/36; 434/61
See application file for complete search history.

(56) References Cited

U.S. PATENT DOCUMENTS

| | | | | |
|---|---|---|---|---|
| 2,805,860 A | | 9/1957 | Littig | |
| 3,866,908 A | | 2/1975 | Hangler | |
| 3,905,597 A | * | 9/1975 | Tabb | 482/61 |
| 4,082,265 A | * | 4/1978 | Berkes | 482/61 |
| D273,882 S | * | 5/1984 | Bryne | D21/664 |
| 4,580,983 A | * | 4/1986 | Cassini et al. | 482/61 |
| 4,750,737 A | * | 6/1988 | Smith | 482/61 |
| 4,925,183 A | * | 5/1990 | Kim | 482/61 |
| 4,932,651 A | * | 6/1990 | Defaux | 482/61 |
| 4,955,600 A | * | 9/1990 | Hoffenberg et al. | 482/61 |
| 5,035,233 A | * | 7/1991 | Ruf | 601/27 |
| 5,547,382 A | * | 8/1996 | Yamasaki et al. | 434/61 |
| 5,816,818 A | * | 10/1998 | Wun | 434/29 |
| 6,004,243 A | * | 12/1999 | Ewert | 482/8 |
| 6,126,577 A | * | 10/2000 | Chang | 482/57 |
| 6,322,480 B1 | * | 11/2001 | Lim et al. | 482/57 |
| 6,932,750 B1 | * | 8/2005 | Dorner | 482/142 |
| 7,060,009 B2 | * | 6/2006 | Greenleaf | 482/61 |

FOREIGN PATENT DOCUMENTS

| | | |
|---|---|---|
| EP | 121186 A1 | 10/1984 |
| JP | 53-104939 A | 9/1978 |

* cited by examiner

*Primary Examiner*—Loan H Thanh
*Assistant Examiner*—Tam Nguyen
(74) *Attorney, Agent, or Firm*—Merchant & Gould P.C.

(57) ABSTRACT

A training bench for cyclists includes a framework. The framework has rollers on which the wheels of a bicycle rest. The framework also has a central support including a platform which is connected to the framework with transverse bars, on which it can move. The platform has an elastically deformable anchoring system serving as a holding base for holding a column. At its free end, the column supports the frame of the bicycle. The anchoring system acts as an absorption member for controlling the movement of the bicycle with regard to the platform and the framework.

6 Claims, 4 Drawing Sheets

TRAINING BENCH FOR CYCLISTS

This application is a national stage entry of PCT/ES04/00175 having an international filing date of Apr. 23, 2004 and claims priority to P200300937, filed Apr. 23, 2003.

The present invention refers to a training bench for cyclists which inc1udes a framework. The framework has freely rotational or rotationally regulated rollers or belts on which the bicycle is located in order to allow the cyclist to be able to pedal thereon, which can be in conditions similar to those of circulation on a public thoroughfare.

Training benches with the constitution set forth are generally used by cyclists, both for their physical preparation and for the study and analysis of their conditions. Whatever the application of the bench may be, it is desirable that the latter allows reproducing and controlling, as exactly as possible, the real traffic conditions which the cyclist may encounter while practicing the sport.

The drawback which training benches have is that in all cases, the person practicing therewith must maintain himself with the bicycle in vertical position by his own equilibrium, with a non-adjustable and limited magnitude stress, as if he constantly moved almost in a straight line, and horizontal movement, which takes away effectiveness from the reproduction of the real conditions in which the cyclist must travel, not only on thoroughfares with different slopes but also with trajectory variations, i.e. with straight and curved sections, in which the cyclist adopts a certain inclination, depending on whether the curve is more or less closed, and on the traffic speed.

The object of the present invention is to eliminate the drawbacks set forth, by means of a training bench constituted such that it allows for exactly reproducing or distorting the real traffic conditions, both with regard to slope variations and to trajectory variations.

This possibility allows that carrying out the training exercises is reproduced in conditions similar to the real ones which the cyclist will find in his usual routes.

With the bench of the invention, the cyclist can carry out complete exercises, with an almost exact reproduction of real traffic conditions, such that it allows the cyclist to pedal even standing or swinging, such as he could carry out in climbing a mountain pass or moving on a curve. The bench of the invention offers sufficient controllable stability in order to be able to carry out the exercises under the mentioned conditions.

The bench of the invention comprises a framework. The framework has parallel freely rotational or rotationally regulated end rollers or belts on which the wheels of the bicycle rest.

Said control can be provided with a computerized motor, such that it acts as such motor (aiding in pedaling), or as a brake, with a variable influence on the rotational stresses of the rollers for the purpose of simulating uphill or downhill travel, as occurs in normal traffic on the road.

Said framework can also have side bars, aiding users with mobility or dizziness problems, granting the system a greater stability for specific uses.

The framework furthermore has a central support assembled thereto, on which the frame of the bicycle rests through the case or casing of the pedal set, or any other point of the bicycle.

Said support is constituted of a platform assembled on the framework through one or more transverse bars on which it can move exclusively in a direction lateral to the cyclist. This platform has an elastic anchoring system from the upper base, serving as the anchoring base of a vertical column, which has support means for the case or casing of the pedal set at its free upper end.

The elastic anchoring system acts as an elastic support means to allow the swinging of the bicycle with regard to the framework on which it is assembled, it and controls its longitudinal movement.

Said elastic system can also be controlled by servomechanisms for the purpose of simulating specific traffic conditions (for example side wind, uneven ground, etc.).

In the training bench of the invention, the rotating rollers or belts have means for controlling their resistance to rotation, by means of a computerized motor-brake, for the purpose of being able to offer and obtain different traffic conditions.

The apparatus can thus be used also as a simulator, balance training system, for studying reflexes, or any type of medical or physical monitoring of the user.

The rollers can be linked by a belt or any connection system, with any transmission ratio. Furthermore, the support has elastic or computerized rigid side stops to adjust the range of variation of its position throughout the transverse bars, a fixed position for said support even being able to be selected. It can also have stops for the wheel in the rollers or belts.

Furthermore, side rolling systems can be arranged in the front and/or rear roller or belt, the purpose of which would be to non-intrusively limit the side movements and to make the assembly safer in view of the bicycle possibly running off the rolling surfaces.

Since the support is assembled on one or more transverse guides of a fixed position, the longitudinal positioning of the bicycle with regard to the support is ensured, without backward or unwanted movements occurring. The uniformity of the contact point of the wheels with the rollers or belts is ensured.

Next, a more detailed description of the training bench of the invention is made, with aid of the attached drawings, in which a non-limiting embodiment example is shown.

Figure 1:
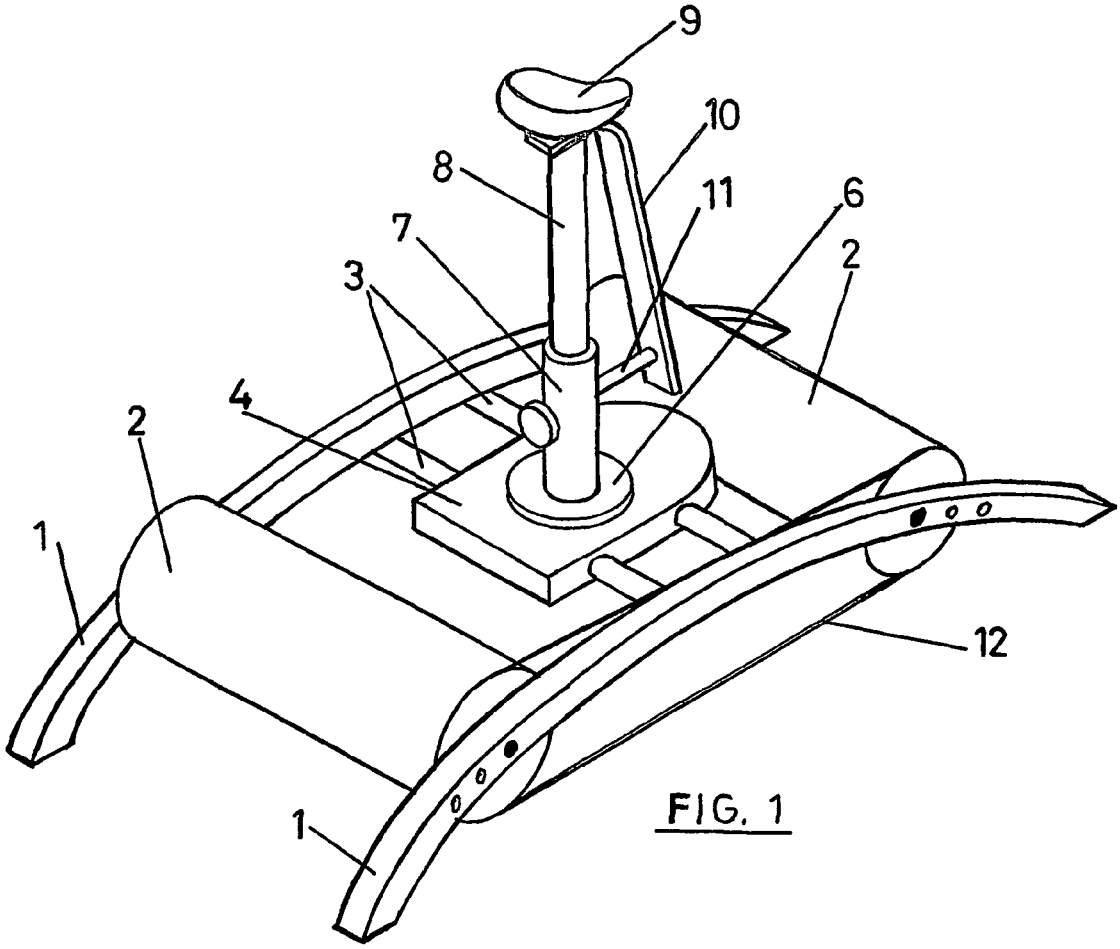
FIG. 1 shows a perspective view of a training bench for cyclists, constituted according to the invention.
Figure 2:
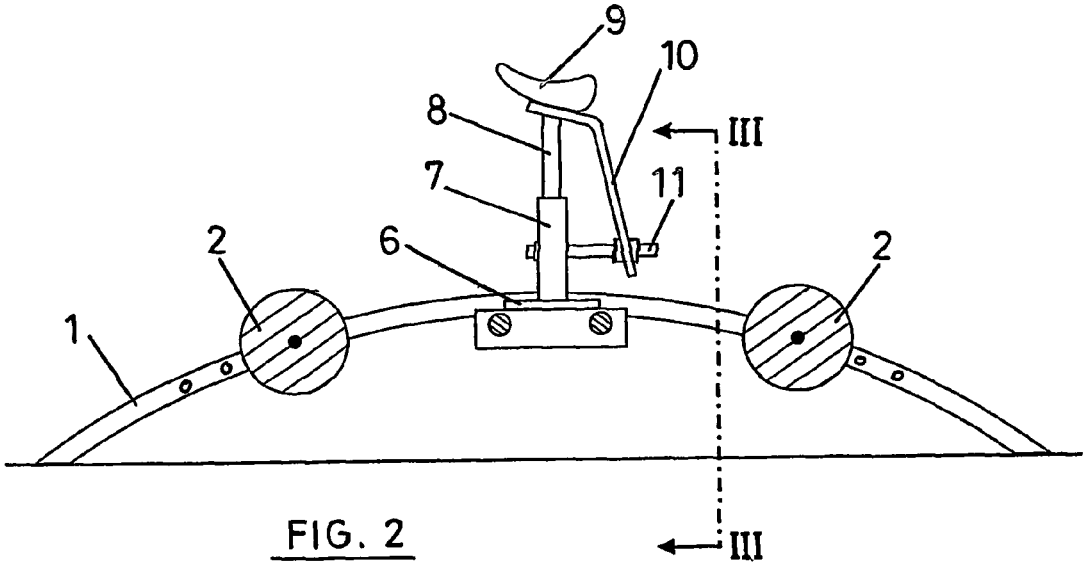
FIG. 2 shows an elevational side view of the bench of FIG. 1.
Figure 3:
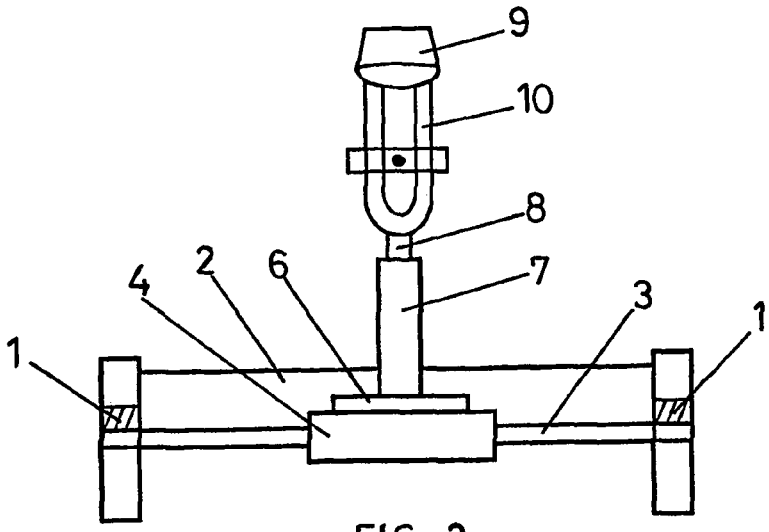
FIG. 3 shows a cross section view of the bench, taken along section line III-III of FIG. 2.

As can be seen in FIGS. 1 to 3, the bench comprises a framework which is constituted of one or more curved longitudinal bars 1, although they can adopt any other shape, between which two freely rotational end rollers are assembled, referenced with number 2, which can be assembled on the longitudinal bars 1 by any system and which have means for regulating the resistance to rotation.

Furthermore, one or more transverse guides referenced with number 3 are assembled between the longitudinal bars 1, between which a central support 4 is assembled.

The support 4 is constituted of a platform in which an elastically compressible and deformable member or system 6 is fixed. This member can consist of one or several silent-blocks in one or several shock absorbers, and/or of springs etc., with adjustable and programmable deformation capacity to limit the swinging angle.

Next to the position of the elastic system 6, the platform 4 has parallel passages through which the support is assembled in the guides 3, which can consist of bars of a cylindrical section or another section. FIGS. 1 and 2 show an embodiment in which the guides 3 are bars of a circular section, wherein the parallel passages of the support 4 in which the guides 3 are inserted are passages of the same cross section as the guides.

Due to their particular circular sections, the passages can have bushings or bearings assembled in order to facilitate their sliding on the guides 3. The platform 4 can furthermore include clamp screws, not shown in the drawings, which connect with the bars or guides 3 to prevent transversal movement of the support 4 and fix the transverse position of said support 4 on the bars or guides 3. Said transverse position can also be regulated by means of springs or any system (elastic, computerized or not), which increases the stability or instability of the system.

The elastically deformable system 6 has a bushing, and another similar part 7, in which an upper column 8 is fixed by any system, which has supporting means 9 at its free end for the case or casing of the pedal set or any portion of the bicycle. As it can be seen in FIG. 1, the bench additionally comprises a side fork 10 which is linked to the bushing 7 by means of a threaded rod 11 and allows for its relative rotation and vertical movement of the column 8 and the supporting means 9.

With the constitution described, the invention can work in two different modes: in the first mode, the bicycle rests on the rollers or belts 2, and not on the support 9, through the casing of the pedal set. Using the first mode, the cyclist can do cycling exercises due to the possibility of free or regulated rotation of the rollers 2, with adjustable stress or difficulty. In the second mode, the user additionally has the possibility of distributing weight between the wheels and the support by means of an elastic system, computerized or not. Therefore, using this second mode, the cyclist can do cycling exercises, due to the possibility of free or regulated rotation of the rollers 2, with adjustable stress or difficulty and furthermore he will be able to tilt the bicycle towards either side, thanks to the possibility of elastic compression and deformation of member 6, through which the horizontal stress is transmitted from the bicycle to the support 4.

The position of this support 4 on the guides 3 will be able to be regulated and fixed by means of the screws.

In the bench of the invention, the longitudinal position of the bicycle, with regard to the framework, is ensured due to the impossibility of movement of the support 4 with regard to said framework.

The elastically deformable member or system 6 offers a certain capacity of rotation and axial movement of the bushing 7, and thereby of the bicycle, with regard to the framework. It also allows for a slight (elastic) longitudinal movement of the bicycle.

An adjustable belt or strip 12 can be assembled between the rollers 2, with any transmission ratio, to achieve different degrees of difficulty.

The distance between the rollers can be adjustable for the purpose of adapting it to the different types of bicycles existing on the market. The belt 12 can also be assembled on pulley wheels of different diameters.

Figure 4:
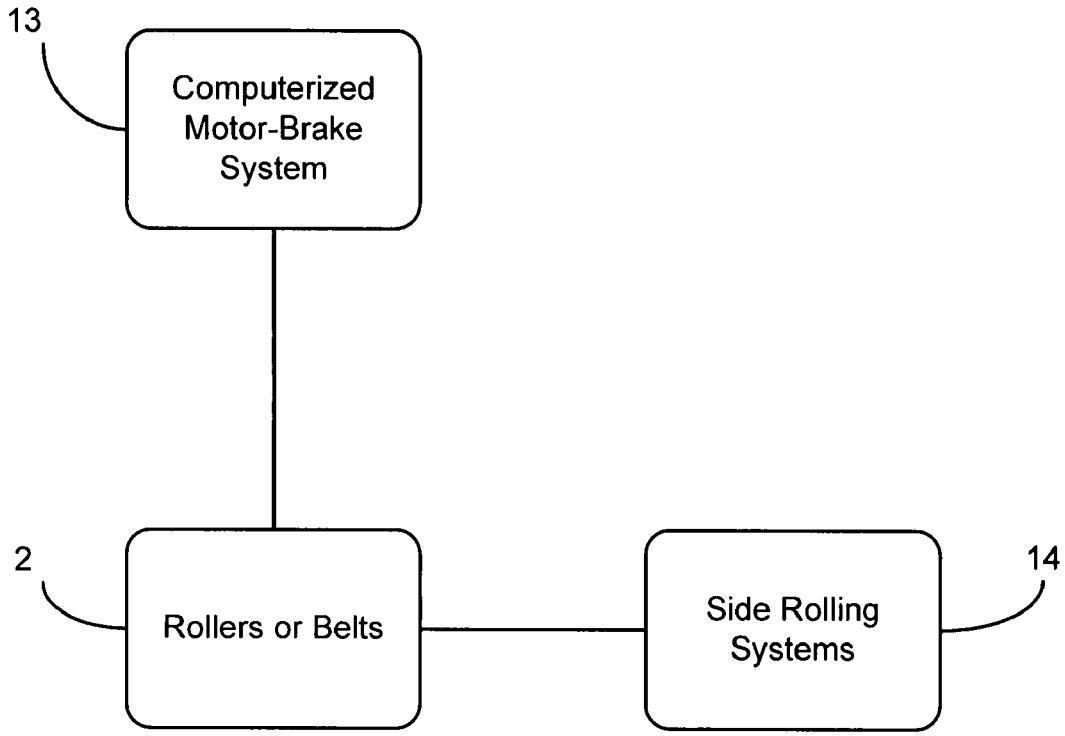
FIG. 4 is a block diagram illustrating a first portion of the functional connection of the training bench of FIG. 1.

FIG. 4 shows a first portion of the functional connection of the training bench of FIG. 1. In particular, a computerized motor-brake system 13 is for the purpose of being able to offer and obtain different traffic conditions. The computerized motor-brake system 13 is connected and used in the rollers or belts 2. In addition, side rolling systems 14 are arranged in the front and/or rear roller or belt 2, the purpose of which would be to non-intrusively limit the side movements and to make the assembly safer in view of the bicycle possibly running off the rolling surfaces.

Figure 5:
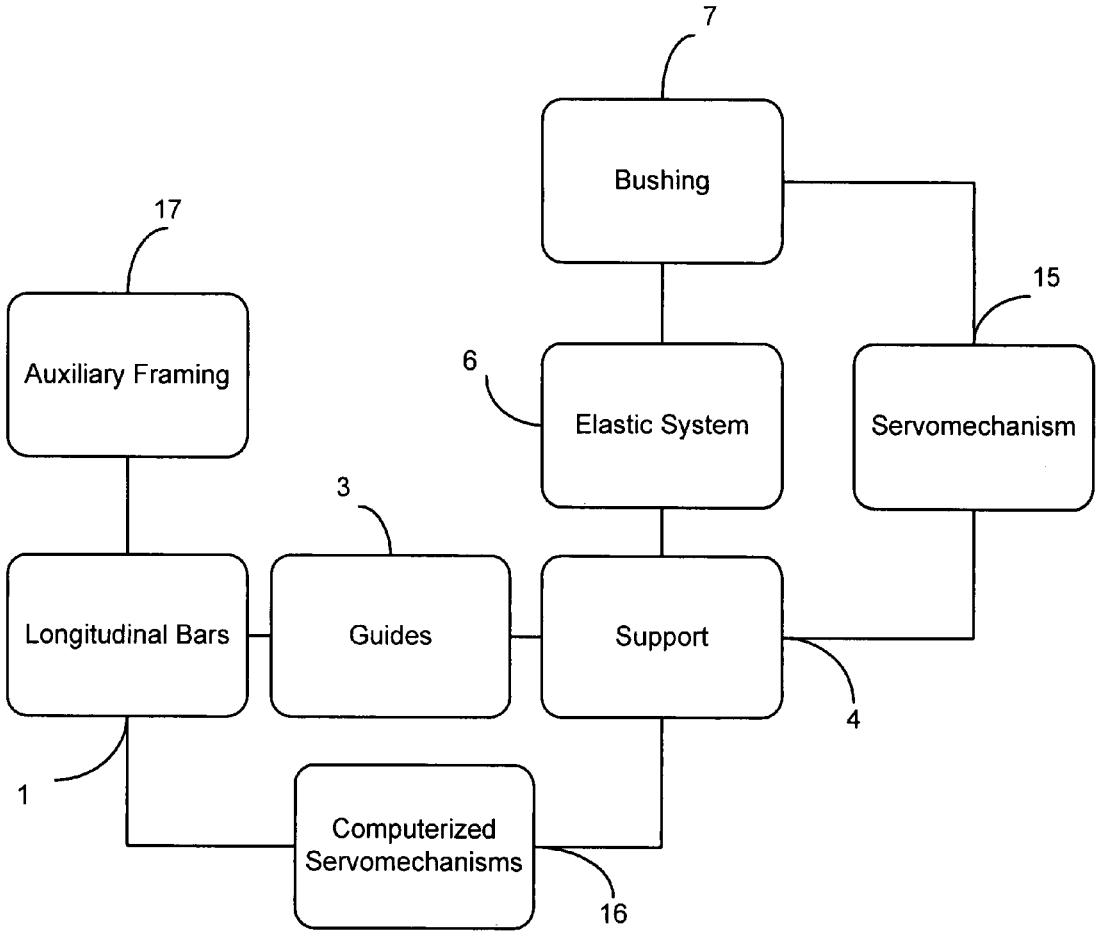
FIG. 5 is a block diagram illustrating a second portion of the functional connection of the training bench of FIG. 1.

FIG. 5 shows a second portion of the functional connection of the training bench of FIG. 1. The elastic system 6 can be controlled by a servomechanism 15. In addition, both the elastic anchoring system 6 and the movement on the transverse guides 3 are controlled by computerized servomechanisms 16 for the purpose of using the system as a simulator with the minimum features. The bench has an auxiliary framing 17 to facilitate the user in getting on the bench and to serve as support and safety grip during the use thereof.

The invention claimed is:

1. A training bench for cyclists, the training bench of the type that supports a bicycle having a front wheel, a rear wheel and a pedal crank portion of the bicycle frame, comprising:

a framework, said framework having two parallel, freely rotational end rollers which engage the front and rear wheels of the bicycle, respectively; and a central support on which the frame of the bicycle is cooperatively supported, the support including a platform connected to the framework with transverse bars on which the platform can move in a free or regulated manners, the platform having an elastically deformable anchoring system cooperatively located on an upper surface of the platform, wherein the anchoring system is arranged and configured to act as a holding base for holding a vertical column providing support for the pedal crank portion of the frame of the bicycle on a free end of the vertical column and as an absorption member to control the movement of the bicycle with regard to the platform and the framework, whereby the frame of the bicycle rests on the vertical column support and is not fixedly connected to the framework.

2. The bench according to claim 1, wherein the platform has one or more parallel through bores, perpendicular to the vertical column, wherein the transverse bars are slidably received into the bores of the support member to support the support member on the framework.

3. The bench according to claim 1, wherein the framework is constituted of two or more longitudinal bars, between which the end rollers and the transverse bars are assembled.

4. The bench according to claim 1, further comprising a computerized motor-brake system in the rollers, which allows for different pedaling forces being required by a user, whereby specific road traffic conditions are reproduced.

5. The bench according to claim 1, wherein both the elastic anchoring system and the movement of the platform on the transverse guides are controlled by computerized servomechanisms for the purpose of using the system as a simulator.

6. The bench according to claim 1, wherein a belt cooperatively connects the two parallel, freely rotational end rollers to one another.

* * * * *